US006529363B2

(12) United States Patent
Waffenschmidt et al.

(10) Patent No.: US 6,529,363 B2
(45) Date of Patent: Mar. 4, 2003

(54) CAPACITOR INTEGRATED INTO TRANSFORMER BY MULTI-LAYER FOIL WINDING

(75) Inventors: Eberhard Waffenschmidt, Aachen (DE); Hubert Raets, Landgraaf (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/884,221

(22) Filed: Jun. 19, 2001

(65) Prior Publication Data

US 2002/0030961 A1 Mar. 14, 2002

(30) Foreign Application Priority Data

Jun. 21, 2000 (DE) ..... 100 30 605

(51) Int. Cl.[7] ..... H01H 9/28
(52) U.S. Cl. ..... 361/270; 336/69
(58) Field of Search ..... 361/270; 336/178, 336/182, 185, 170, 69, 223; 363/147; 307/89, 98

(56) References Cited

U.S. PATENT DOCUMENTS

| | | | | | |
|---|---|---|---|---|---|
| 3,210,706 | A | * | 10/1965 | Book | 336/170 |
| 3,579,084 | A | | 5/1971 | Moyer | 321/16 |
| 3,688,232 | A | * | 8/1972 | Szatmari | 336/180 |
| 3,894,270 | A | * | 7/1975 | Manske | 315/379 |
| 5,012,179 | A | * | 4/1991 | Okumura | 315/411 |

OTHER PUBLICATIONS

Patent Abstracts of Japan, vol. 007, No. 107 (E–174), May 11, 1983, JP 58030114 A.

* cited by examiner

*Primary Examiner*—Shawn Riley

(57) ABSTRACT

A switched-mode power supply includes at least one capacitor (9) and a transformer having a plurality of windings (12, 17). Advantageously a capacitor (9) is integrated in the transformer by way of at least one multi-layer foil winding (12). This foil winding (12) of the transformer consists of a plurality of planar conductive electrodes (1, 2, 3, 4, 5, 6) which, alternately with an insulating dielectric foil, are stacked onto each other to form an electrode stack.

9 Claims, 3 Drawing Sheets

CAPACITOR INTEGRATED INTO TRANSFORMER BY MULTI-LAYER FOIL WINDING

CROSS REFERENCE TO RELATED APPLICATIONS

The present invention is related to and claims priority under 35 USC §119 from German patent application number 10030606.5 filed on Jun. 21, 2000.

FIELD OF THE INVENTION

The invention relates to a switched-mode power supply including at least one capacitor and including a transformer having a plurality of windings.

BACKGROUND

U.S. Pat. No. 5,153,812 discloses a so-called LC element having an integrated inductance and capacitance. It alternately comprises planar electrodes and insulating layers. These alternating layers are wound so as to form a spiral coil. This LC element is used as a filter.

SUMMARY

It is an object of the invention to reduce the number of electrical parts such as capacitors and coils in a switched-mode power supply so as to enable a simple and low-cost production in large quantities.

According to the invention this object is achieved in that the capacitor is integrated in the transformer by means of at least one multi-layer foil winding and this foil winding of the transformer consists of a plurality of planar conductive electrodes which, alternately with an insulating dielectric foil, are stacked onto each other to form an electrode stack.

In this manner the required capacitors can be integrated in the transformer of the switched-mode power supply without a high cost. This applies both to the resonance capacitor in a switched-mode power supply constructed as a resonant converter, and to the smoothing capacitor, which takes the form of a separate electrolytic capacitor in conventional switched-mode power supplies.

An embodiment has the advantage that the electrical parameters of the transformer can be varied by means of a core of a permeable material without the windings being changed. In this way it possible to realize, for example, an additional stray inductance in a simple manner.

An embodiment relates to a star arrangement of the integrated capacitors is obtained in that each of the individual electrodes only has a star point electrode as counter-electrode and does not have any further separate electrode. The star arrangement permits an adaptation to frequently used circuits in switched-mode power supplies, which often include a star arrangement of capacitances.

An embodiment leads to an increase of the integrated capacitance of a switched-mode power supply in accordance with the invention owing to the parallel-connected electrodes and capacitors. Since the layered electrodes have properly accessible contacts at their ends the electrodes can simply be electrically interconnected in an alternating fashion, as a result of which the desired parallel connection of the capacitors is obtained.

An embodiment enables a large-area contact between interconnected electrodes to be obtained, as a result of which the electrical resistance between the electrodes is reduced.

Moreover, large-area contacts allow a simple automatic production with a low risk of poorly conducting electrical connections.

An embodiment has the advantage that the individual turns of the winding are electrically insulated with respect to one another in a reliable and simple manner. At the same time, this provides further possibilities of influencing the dielectric characteristics of the device, notably of the integrated capacitances.

An embodiment yields advantages in the fabrication of the electrodes. The electrodes, which are electrically insulated with respect to one another, can be manufactured by simple vapor deposition of a metal layer on one or both sides of the insulating foil. Vapor deposition enables particularly thin and, consequently, space-saving electrodes to be manufactured.

BRIEF DESCRIPTION OF THE DRAWINGS

Various embodiments of the invention will be described in more detail, by way of example, with reference to the drawings. In the drawings.

DETAILED DESCRIPTION

Figure 1:
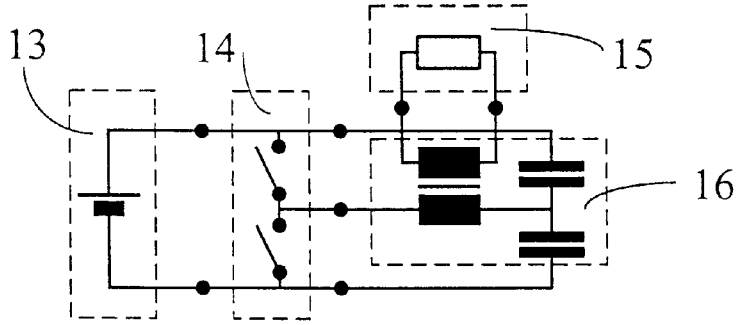
FIG. 1 shows a circuit diagram of a switched-mode power supply in accordance with the invention, including a half bridge and a double capacitor.

An switched-mode power supply in accordance with the invention is made up of a plurality of modules. First of all, there is a voltage source module 13, which in a customary manner includes a capacitor and supplies a rectified voltage. Furthermore, there is a module having a semiconductor circuit 14, 14*a*, which is a half-wave or full-wave bridge circuit. These circuits 14, 14*a* make it possible to change the output voltage by varying the switching frequency or by pulse-width modulation. The switched-mode power supply further includes a transformer module 16, to be described in greater detail hereinafter, and a load module 15 formed by a connected load. The load module 15 may range from a simple resistance to a complex circuit including high voltage windings.

In accordance with the invention the transformer module 16 is realized as a single device. This device consists of a plurality of planar, preferably rectangular electrodes 1, 2, 3, 4, 5, 6. The number of electrodes 1, 2, 3, 4, 5, 6 is variable. The embodiment shown in FIG. 7 employs six electrodes in total.

The electrodes 1, 2, 3, 4, 5, 6 are insulated with respect to one another by means of a dielectric foil 8. Thus, a capacitor is formed between every time two insulated electrodes. The stacked foils 8 and electrodes 1, 2, 3, 4, 5, 6 form an electrode stack. In order to simplify the fabrication of this electrode stack and in order to obtain a small layer thickness of the electrode stack the electrodes 1, 2, 3, 4, 5, 6 may be vapor-deposited onto the insulating foil 8. This enables a low-cost production in large series. In order to configure the connection of the capacitors the rectangular electrodes 1, 2, 3, 4, 5, 6 have electrical contacts on at least two sides.

Figure 4:
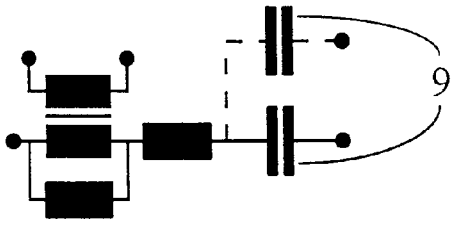
FIG. 4 shows a circuit diagram of a transformer module having one or two capacitors and an inductance in parallel with the secondary winding of the transformer.
Figure 5:
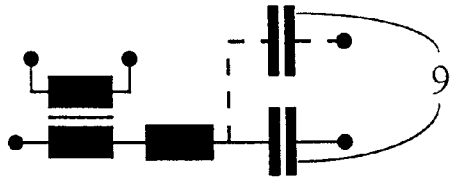
FIG. 5 shows a circuit diagram of a transformer module having one or two capacitors and an inductance in parallel with the secondary winding of the transformer as well as an inductance in series with the secondary winding of the transformer.
Figure 6:
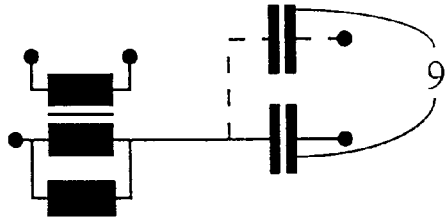
FIG. 6 shows a circuit diagram of a transformer module having one or two capacitors and an inductance in series with the secondary winding of the transformer, FIG. 7 diagrammatically shows an integrated transformer module.

In order to obtain a star arrangement of the capacitors 9, as is shown in FIGS. 4 to 6, every other electrode 1, 3, 5 of the electrode stack is electrically interconnected at one end. This is the star point. For this purpose, the electrical contacts of the electrodes 1, 3, 5 are connected over a large area to a conductive layer, for example a metal layer, and form a common connection. The other electrodes 2, 4, 6 have separate electrical connections. FIG. 1 shows an example of the use of this star arrangement in the transformer module 16 of a switched-mode power supply in accordance with the invention. In a switched-mode power supply as shown in FIG. 1 the parallel connection of the two capacitors 9 defines the resonance behavior. This results in a smaller a.c. load of the current from the voltage source module 13 and enables the electrolytic capacitor to be dispensed with if the capacitances of the capacitors 9 are large enough.

Figure 2:
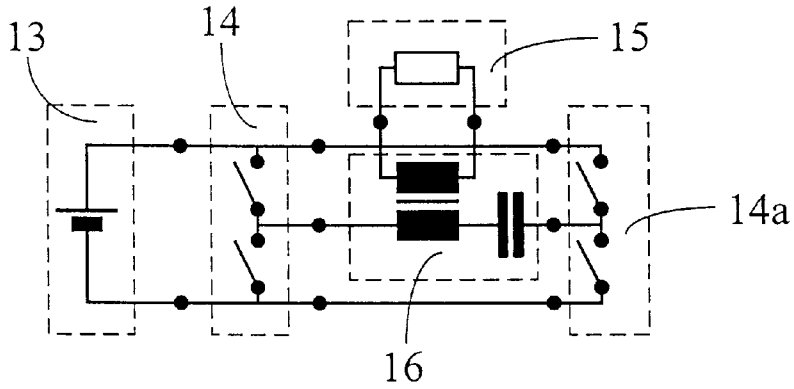
FIG. 2 shows a circuit diagram of a switched-mode power supply in accordance with the invention, including a full bridge and a capacitor.
Figure 3:
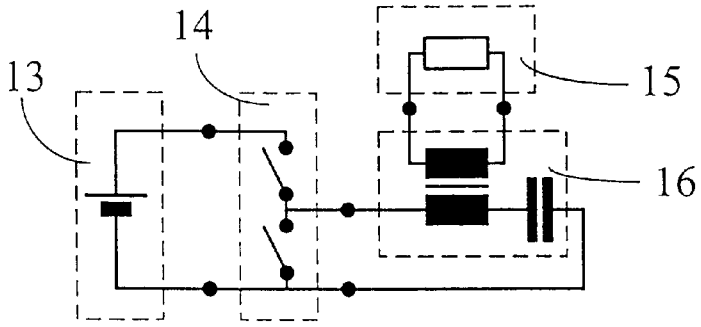
FIG. 3 shows a circuit diagram of a switched-mode power supply in accordance with the invention, including a half bridge and a capacitor.

If the transformer module 16 has only one capacitor 9, its capacitance should be as high as possible. For this purpose a parallel arrangement of capacitors 9 is integrated. For a parallel arrangement of the capacitors 9 every other electrode of the electrode stack is electrically interconnected. For this purpose, the electrical contacts of the electrodes 1, 3, 5 and the electrical contacts of the counter-electrodes 2, 4, 6 are connected to a conductive layer, for example a metal layer, over a large area and have a common connection. Examples for the use of the invention in a switched-mode power supply are shown in FIG. 2 and FIG. 3, where the capacitance of the capacitor in the transformer module is increased by a parallel arrangement of the electrodes 1, 2, 3, 4, 5, 6.

Figure 8:
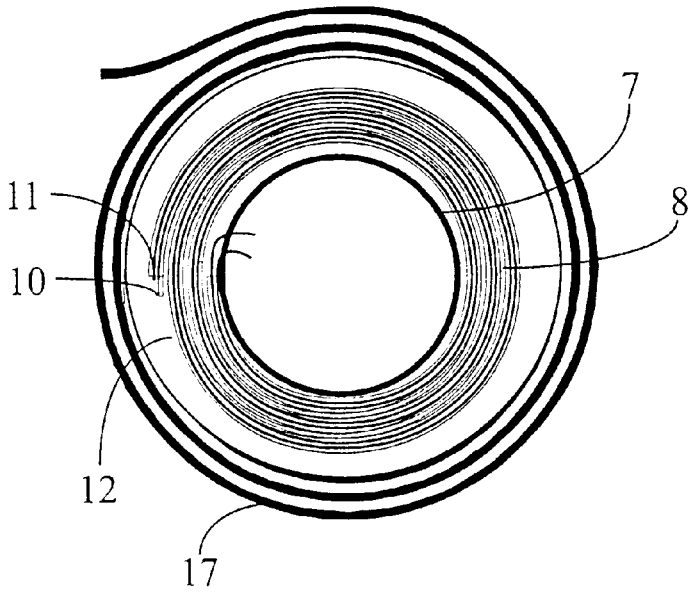
FIG. 8 is a sectional view of an integrated transformer module.

In order to form a transformer module 16 with a transformer by means of the electrode stack the electrode stack is wound to form a coil winding 12 as shown in FIG. 8. Depending on the desired type and depending on the size of the electrodes 1, 2, 3, 4, 5, 6 the turns 11 of the winding 12 are wound either to overlap or, in the case of narrow electrodes, onto one another into a spiral shape. For the electrical insulation of the individual turns 11 with respect to each other an additional insulating layer 10 is interposed between the turns 11, the electrical properties of the transformer being also variable through the thickness and the nature of the material of said additional insulating layer.

Figure 7:
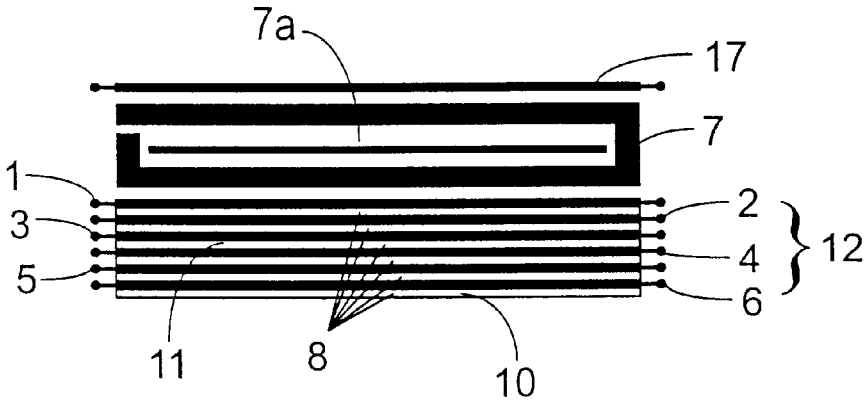

Moreover, the coil winding 12 is wound onto a ferrite core 7, which is shown in FIGS. 7 and 8. The ferrite core 7, which has an arbitrary $\mu$, serves primarily as a common iron core for the winding 12 and one or more secondary windings 17 of the transformer. The secondary windings 17 may then simply be wound around the first winding 12 and the ferrite core 7. Instead of a secondary winding 17 having a wound electrode stack it is also possible to use a regular secondary winding 17 of copper wire or a metal foil, which winding may also be arranged on a board. Such an arrangement is shown diagrammatically in FIG. 7, in which only one turn 11 of a primary winding and one turn of a secondary winding 17 is shown. The star arrangement of capacitors as shown in FIGS. 1, 4, 5 and 6 is realized by means of a star connection of the electrodes 1, 2, 3, 4, 5, 6.

The ferrite core 7 is typically closed but it may also have an air gap in order to reduce the main inductance of the transformer. Moreover, a so-called stray flux limb 7*a* may be added in order to reduce the coupling to the other windings and thereby, as a result of the increase of the stray inductance, provide an integrated series inductance. Thus, it is possible to realize different arrangements of inductances, which are available in addition to the transformer, as is shown in FIGS. 4 to 6.

What is claimed is:

1. A switched-mode power supply comprising:

at least one capacitor (9) and a transformer, which has a plurality of windings (12, 17), wherein the capacitor (9) is integrated in the transformer by means of at least one multi-layer foil winding (12) and this foil winding (12) of the transformer consists of a plurality of planar conductive electrodes (1, 2, 3, 4, 5, 6) which, alternately with an insulating dielectric foil, are stacked onto each other to form an electrode stack; and at least one semiconductor circuit, which is adapted to change an output voltage of the switched-mode power supply by varying a switching frequency or by pulse-width modulation.

2. A switched-mode power supply as claimed in claim 1, wherein the windings (12, 17) are wound around a core (7) and this core (7) has an air gap of arbitrary size and/or shape and/or has a stray flux core (7*a*).

3. A switched-mode power supply as claimed in claim 2, characterized in that at one end a first electrode (1) is connected to the respective next but one electrode (1, 3, 5), while at the other end the remaining electrodes (2, 4, 6) are connected in an electrically conductive fashion.

4. A switched-mode power supply, comprising:

at least one capacitor (9) and including a transformer having a plurality of windings (12, 17), which are wound around a core (7) having an air gap of arbitrary size and/or shape, and/or having a stray flux core (7*a*), wherein the at least one capacitor (9) is integrated in the transformer by means of at least one multi-layer foil winding (12) and this foil winding (12) of the transformer consists of a plurality of planar conductive electrodes (1, 2, 3, 4, 5, 6), which, alternately with an insulating dielectric foil, are stacked onto each other to form an electrode stack; and all of the plurality of planar conductive electrodes (1, 2, 3, 4, 5, 6) have an electrically conductive contact at one end, while at its other end the first electrode (1) is connected to the respective next but one electrode (1, 3, 5) in an electrically conductive fashion and these interconnected electrodes (1, 3, 5) have a common electrically conductive contact, which forms the star point.

5. A switched mode power supply as recited in claim 4, wherein those of the plurality of electrodes (1, 2, 3, 4, 5, 6), which have a common electrical contact are laterally connected in an electrically conductive fashion at one or more sides over the whole length of the electrode stack.

6. A switched mode power supply as recited in claim 5, wherein at least one additional insulating foil (10) is interposed between each turn (11) of the winding (12).

7. A switched mode power supply as recited in claim 5, wherein at least one of the plurality of electrodes (1, 2, 3, 4, 5, 6) is a thin metal layer which is applied to one or both sides of an insulating dielectric foil (8) by vapor deposition or another coating process.

8. A switched-mode power supply as claimed in claim 1, wherein said at least one semiconductor circuit is a half-wave bridge circuit.

9. A switched-mode power supply as claimed in claim 1, wherein said at least one semiconductor circuit is a full-wave bridge circuit.

* * * * *